US005996181A

United States Patent [19]

Fuchs

[11] Patent Number: 5,996,181

[45] Date of Patent: Dec. 7, 1999

[54] APPARATUS FOR BUNDLING A DRAFTED ROVING

[75] Inventor: Helmut Fuchs, Linz, Austria

[73] Assignee: Textilmaschinenfabrik Dr. Ernst Fehrer Aktiengesellschaft, Leonding, Austria

[21] Appl. No.: 09/156,233

[22] Filed: Sep. 18, 1998

[30] Foreign Application Priority Data

Sep. 30, 1997 [AT] Austria ..... 1653/97

[51] Int. Cl.[6] ..... D01H 5/72

[52] U.S. Cl. ..... 19/150; 19/157; 19/288; 57/315; 57/352

[58] Field of Search ..... 19/66 R, 286, 19/287, 288, 289, 150, 157; 57/315, 328, 330, 333, 350, 351, 352, 408

[56] References Cited

U.S. PATENT DOCUMENTS

| | | | |
|---|---|---|---|
| 5,085,046 | 2/1992 | Fehrer | 57/315 |
| 5,090,192 | 2/1992 | Stahlecker | 57/328 |
| 5,285,624 | 2/1994 | Stahlecker | 57/328 |
| 5,431,005 | 7/1995 | Fehrer | 57/315 |
| 5,617,714 | 4/1997 | Fehrer | 57/315 |
| 5,778,653 | 7/1998 | Stahlecker | 57/401 |

FOREIGN PATENT DOCUMENTS

| | | | |
|---|---|---|---|
| 3714212 | 11/1988 | Germany | 57/328 |
| 40 07 607 | 9/1991 | Germany . | |
| 43 23 472 | 1/1995 | Germany . | |

*Primary Examiner*—Michael A. Neas
*Attorney, Agent, or Firm*—Collard & Roe, P.C.

[57] ABSTRACT

There is described an apparatus for bundling a drafted roving (4), comprising a rotating conveying surface (3) provided with air through-holes (6) succeeding each other in direction of rotation (9), and comprising a suction means connected to the conveying surface (3) on the side facing away from the roving (4) in the vicinity of the air through-holes (6), which suction means forms a slot-like suction zone (5) for the roving (4) extending in direction of rotation (9) of the conveying surface (3). To create advantageous constructional conditions, it is proposed that the suction zone (5) should have at least one suction slot tapering in direction of rotation (9) of the conveying surface (3) from at least two rows of holes to one row of holes.

4 Claims, 1 Drawing Sheet

APPARATUS FOR BUNDLING A DRAFTED ROVING

Figure 1:
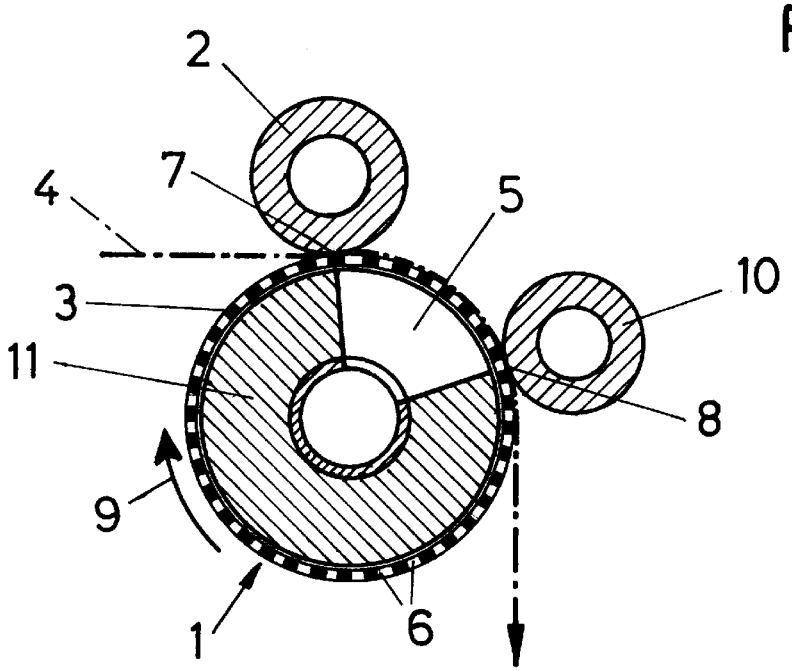

This invention relates to an apparatus for bundling a drafted roving, comprising a rotating conveying surface provided with air through-holes succeeding each other in direction of rotation, and comprising a suction means connected to the conveying surface in the vicinity of the air through-holes on the side facing away from the roving, which suction means forms a slot-like suction zone for the roving, which extends in direction of rotation of the conveying surface.

For advantageously twisting a drafted roving to obtain a yarn, the cross-section of the drafted roving should possibly be adapted to the future yarn cross-section. Since upon drafting the roving adopts the shape of a band, this means that for bundling the drafted roving corresponding transverse forces must be exerted on the fibers thereof. To this end, the drafted roving is guided over a rotating conveying surface, which is provided with air through-holes through which the roving is sucked against the conveying surface with the aid of a suction means, namely in the vicinity of a slot-like suction zone that is inclined at an acute angle with respect to the direction of rotation of the conveying surface, so that due to the resulting transverse component of the suction flow a bundling effect is exerted on the fibers deflected along the inclined suction zone, which bundling effect can additionally be supported by an air flow aligned transverse to the roving and extending above the conveying surface. Moreover, it is known (DE 43 23 472 A1) to provide only a single row of air through-holes arranged in direction of rotation of the conveying surface, which air through-holes are guided over a suction slot extending in direction of rotation, so that an air flow is formed around the individual air through-holes in the vicinity of the slot-like suction zone, which air flow is increasing towards the through-holes, so that the outer fibers of a roving guided in the vicinity of this row of holes are entrained towards such row of holes. What is advantageous in this known apparatus is the fact that the fibers need not be deflected from their conveying direction, which, however, also involves the disadvantage that the collection effect on the fibers remains restricted due to the comparatively small transverse forces.

It is therefore the object underlying the invention to develop an apparatus for bundling a drafted roving as described above with simple means such that an improved bundling effect on the roving can be achieved without having to accept a deflection of the roving from the direction of rotation of the conveying surface.

This object is solved by the invention in that the suction zone has at least one suction slot tapering in direction of rotation of the conveying surface from at least two rows of holes to one row of holes.

By providing at least two rows of holes and one suction slot, which tapers in direction of rotation of the conveying surface from two rows of holes to one row of holes, the air through-holes of the one row of holes are uncovered more and more in direction of rotation of the conveying surface as a result of the tapering suction slot, so that the fibers of the drafted roving seized by this row of holes are safely conveyed towards the row of holes remaining uncovered, because the outer flow components of the row of holes uncovered more and more are displaced towards the row of holes remaining uncovered. This provides for an additional bundling effect, without having to apply a transverse force by deflecting the roving from the direction of rotation of the conveying surface.

To ensure a symmetric bundling of the drafted roving, the suction slot should advantageously taper from at least three rows of holes towards the middle one of these three rows of holes. In this case, the outer fibers of the drafted roving are analogously displaced on both sides towards the middle row of holes for bundling the roving. It need probably not be particularly emphasized that more than three rows of holes may also be used, in particular for spinning coarser yarns. In this connection it should also be pointed out that the diameter of the air through-holes of at least that row of holes towards which the suction slot tapers on the outlet side should be adapted to the future yarn diameter.

Finally, two or more suction slots or suction slot portions tapering in direction of rotation may be provided one behind the other in direction of rotation, of which suction slots at least the last one in direction of rotation tapers towards one row of holes, to ensure special bundling effects. However, the arrangement of two or more suction slot portions or suction slots depends on the available length of the conveying distance of the roving on the rotating conveying surface.

Figure 2:
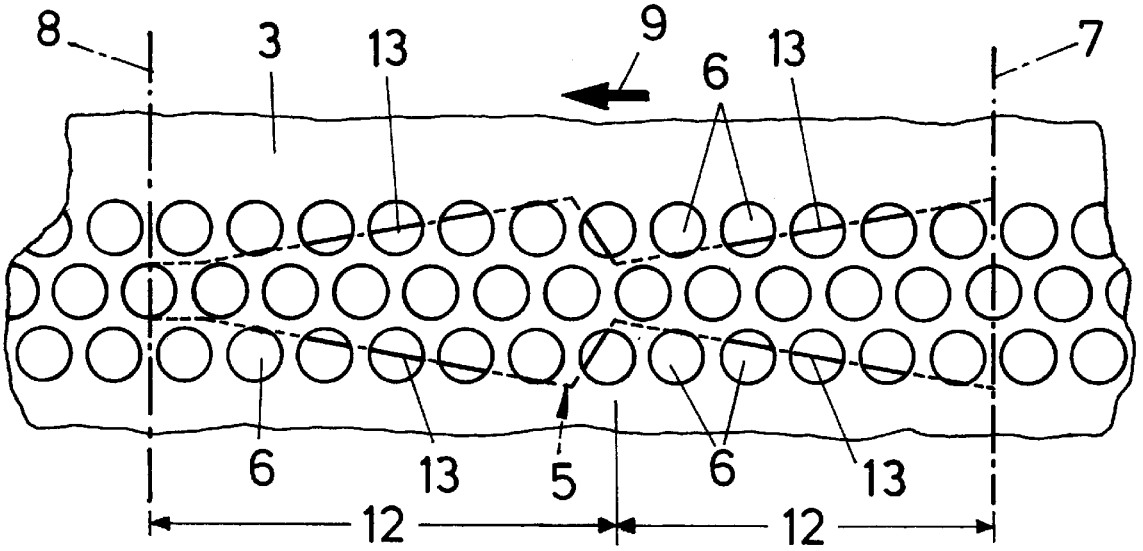

In the drawing, the subject-matter of the invention is represented by way of example, wherein:

FIG. 1 represents an inventive apparatus for bundling a drafted roving in a schematic cross-section, and FIG. 2 represents a top view of segments of a development of the conveying surface in the vicinity of the suction zone on an enlarged scale.

In accordance with the embodiment shown in FIG. 1, the one discharge roller 1 of a pair of discharge rollers 1, 2 of a drafting arrangement not represented in detail constitutes a rotating conveying surface 3 for the drafted roving 4, which is drawn against the conveying surface 3 in the vicinity of a suction zone 5. For this purpose, the discharge roller 1 forms rows of air through-holes 6 offset with respect to each other with a gap in direction of rotation, as this can be taken in particular from FIG. 2. In the area between the nip line 7 between the two discharge rollers 1 and 2 and the nip line 8 between the discharge roller 1 and a billy roller 10 disposed with a distance subsequent to the discharge roller 2 in direction of rotation 9, the suction zone 5 is provided, which is formed by a suction means comprising a suction insert 11. This suction zone 5 forms two suction slot portions 12, whose slot width each tapers in direction of rotation, namely from a width comprising all three rows of holes to one row of holes, as this can be clearly seen in FIG. 2. This particular suction slot design effects that the air through-holes 6 of the outer rows of holes are uncovered more and more by the slot edges 13 in direction of rotation 9, so that the outer flow portions, too, are increasingly displaced towards the middle row of holes in direction of rotation 9, which leads to an increasing lateral displacement of the fibers disposed in the vicinity of the outer rows of holes towards the middle row of holes and thus a corresponding bundling of the roving.

It need probably not be particularly emphasized that the invention is not restricted to the illustrated embodiment, because it is merely decisive to ensure that at least one row of holes is increasingly uncovered in the suction zone in conveying direction, in order to achieve a corresponding lateral displacement of the roving fibers disposed in the vicinity of this row of holes. The conveying surface 3 may advantageously be designed as roller, but it would basically also be possible to use instead a rotating band or a rotating belt. The diameter and the spacing of the air through-holes 6 may be chosen corresponding to the respective requirements and be adapted to the conditions defined by the roving 4.

I claim:

1. An apparatus for bundling a drafted roving, which comprises (a) a conveying surface for supporting the roving and rotatable in a direction of rotation, the conveying surface defining rows of air passage holes succeeding each other in the direction of rotation, and (b) a suction means arranged adjacent a side of the conveying surface facing away from the roving and underlying the air passage holes, the suction means forming a suction zone having (1) at least one suction slot extending in the direction of rotation and tapering in said direction from at least two of said rows of air passage holes towards one of said rows.

2. The apparatus of claim 1, wherein the suction slot tapers from three of said rows of air passage holes towards a middle one of said three rows.

3. The apparatus of claim 1, wherein the suction zone has two suction slots succeeding each other in the direction of rotation, at least the succeeding one of the suction slots tapering in said direction from at least two of said rows towards the one row.

4. The apparatus of claim 1, wherein the suction slot comprises two suction slot portions succeeding each other in the direction of rotation, at least the succeeding one of the suction slot portions tapering in said direction from at least two of said rows towards the one row.

* * * * *